US006116814A

United States Patent [19]

Dietrichson

[11] Patent Number: 6,116,814

[45] **Date of Patent: *Sep. 12, 2000**

[54] METHOD FOR APPLYING MARKINGS AND SIGNS ON A SURFACE

[75] Inventor: Stein Dietrichson, Fredrikstad, Norway

[73] Assignee: Rieber & Son, Division Nor-Skilt, Moss, Norway

[ * ] Notice: This patent issued on a continued prosecution application filed under 37 CFR 1.53(d), and is subject to the twenty year patent term provisions of 35 U.S.C. 154(a)(2).

[21] Appl. No.: 09/077,441

[22] PCT Filed: Dec. 17, 1996

[86] PCT No.: PCT/NO96/00289

§ 371 Date: May 29, 1998

§ 102(e) Date: May 29, 1998

[87] PCT Pub. No.: WO97/22757

PCT Pub. Date: Jun. 26, 1997

[30] Foreign Application Priority Data

Dec. 20, 1995 [NO] Norway ..... 955174

[51] Int. Cl.[7] ..... E01C 23/16

[52] U.S. Cl. ..... 404/94; 404/93

[58] Field of Search ..... 404/94

[56] References Cited

U.S. PATENT DOCUMENTS

| | | | |
|---|---|---|---|
| 3,844,669 | 10/1974 | Eigenmann . | |
| 3,902,666 | 9/1975 | Ito et al. | 404/94 |
| 4,012,247 | 3/1977 | Eigenmann . | |
| 4,071,384 | 1/1978 | Eigenmann . | |
| 4,102,718 | 7/1978 | Eigenmann . | |
| 4,203,878 | 5/1980 | Bauer | 404/94 |
| 4,373,670 | 2/1983 | Kilner | 404/94 |

*Primary Examiner*—Eileen D. Lillis
*Assistant Examiner*—Raymond W. Addie
*Attorney, Agent, or Firm*—Cohen, Pontani, Lieberman & Pavane

[57] ABSTRACT

Method for applying markings or signs to a surface (1), such as road surfaces and the like, comprising the laying down of a layer of a heated mass of a thermoplastic material (3). Before the laying down of thermoplastic material (3) there is applied a primer layer (2) on the surface (1), consisting of a curable plastic material which comprises two or more components.

6 Claims, 1 Drawing Sheet

METHOD FOR APPLYING MARKINGS AND SIGNS ON A SURFACE

Figure 1:
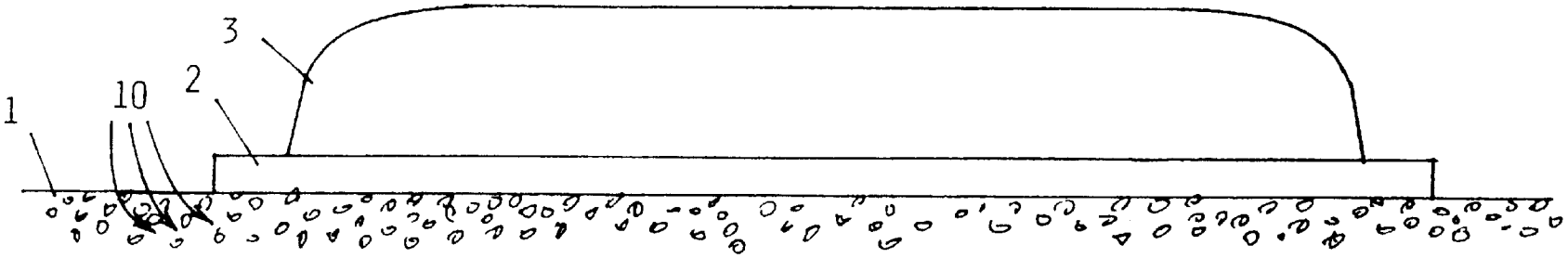

This invention relates to the application of markings or signs on a surface, in particular road surfaces and the like. Other and similar surfaces which may be of interest in this connection, are for example industry floors which in certain cases are subjected to corresponding stresses and wear as roads.

For road markings for example in the form of edge lines, a good durability and long lifetime is desired, so that the expenses related to marking can be kept as low as possible. In addition to the direct wear resulting from car traffic, in particular with studded tires, it is also a great problem to obtain sufficient adhesion between the marking applied and the actual road suface. This is a problem that is rather accentuated when concrete pavements of high strength are concerned, but also other forms of road pavement, such as meagre or stone-rich asphalt pavements, i.e. asphalt pavements having a small content of bitumen. The difficulties of a good and durable adhesion is related to, inter alia, that water and moisture can penetrate into the road surface and from the underside weaken the adhesion of applied markings.

There are previously known a number of different methods and materials for use in such road marking and the like. U.S. Pat. No. 4,102,718 relates to a road marking material in tape form, which incorporates a primer layer of a thermoplastic material, which beforehand is bonded to the actual marking tape before being laid down on the road surface. As an initial step the road surface may be prepared with a wetting agent.

Norwegian patent 122.385 is more interesting since to a large extent it addresses the adhesion of a road marking mass being laid down on the road surface. There is however the question of sulphurous masses, which are not of any interest in the present connection. At the end of the patent specification it is mentioned briefly that priming can be applied, but without any closer discussion of the type of priming material.

As further examples of prior art of more remote interest, reference can be made to Norwegian patent 122.602 and Norwegian published patent application 126.029, Swedish published patent application 341.874, European patent application 0397.406 and U.S. Pat. No. 4,708,518. The latter patent specification is related to the above mentioned U.S. patent. It is to be noted that the Swedish patent publication referred to, in addition to a thermoset plastic as road marking material, also describes thermoplastic materials. The present invention takes as a starting point a method comprising the laying down of a layer of a heated mass of a thermoplastic material. The composition of such a known and typical thermoplastic material for this purpose, is as follows:

thermoplastic binder minimum 15% pigment (white) maximum 8% glass pearls 0–40% filler (sand/limestone powder) ad. 100%

This typical road marking mass based on thermoplastic materials result in wear resistant and durable lines and the material hardens in seconds upon being laid down, so that for example car traffic can quickly run as normal afterwards without any risk of damages to cars or marking lines. Moreover it is important to remark that such a mass on a thermoplastic bases does not contain solvents or other substances that may be detrimental to health or environment. The mass can be laid out in a thickness from 1–6 mm.

According to the invention it has surprisingly been found that substantially improved results are obtained by applying a primer layer to the surface before laying down a heated mass of thermoplastic material, whereby the primer layer consists of a curable plastic material comprising two or more components.

As a curable plastic material to be employed here, there are several possible types, for example polyurethane. This because, inter alia, polyurethane is heat curable, so that the hardening of such a primer layer to a substantial degree will be provided for by the immediately following and superposed layer of heated thermoplastic material. Thus the heat being given off from the heated road marking mass makes it unnecessary to provide for any specific drying or curing time for the primer layer, so that the pre-treatment with primer and the laying down of the actual road marking mass can take place in substantially simultaneous operations provided for by one and the same machine.

The method according to the invention is particularly advantageous when employing an epoxy plastic as the heat curable plastic material in the primer layer. This material leads to a particularly efficient impregnation or sealing of the road surface and the small pores or depressions occuring therin, so that water penetration is prevented and there is obtained a very good adhesion. Compared to usual primer types for various purposes, which only give a rather superficial adhesion to road surfaces of interest, an epoxy primer layer in combination with the thermoplastic road marking mass has proved to be unexpectedly advantageous.

Figure 2:
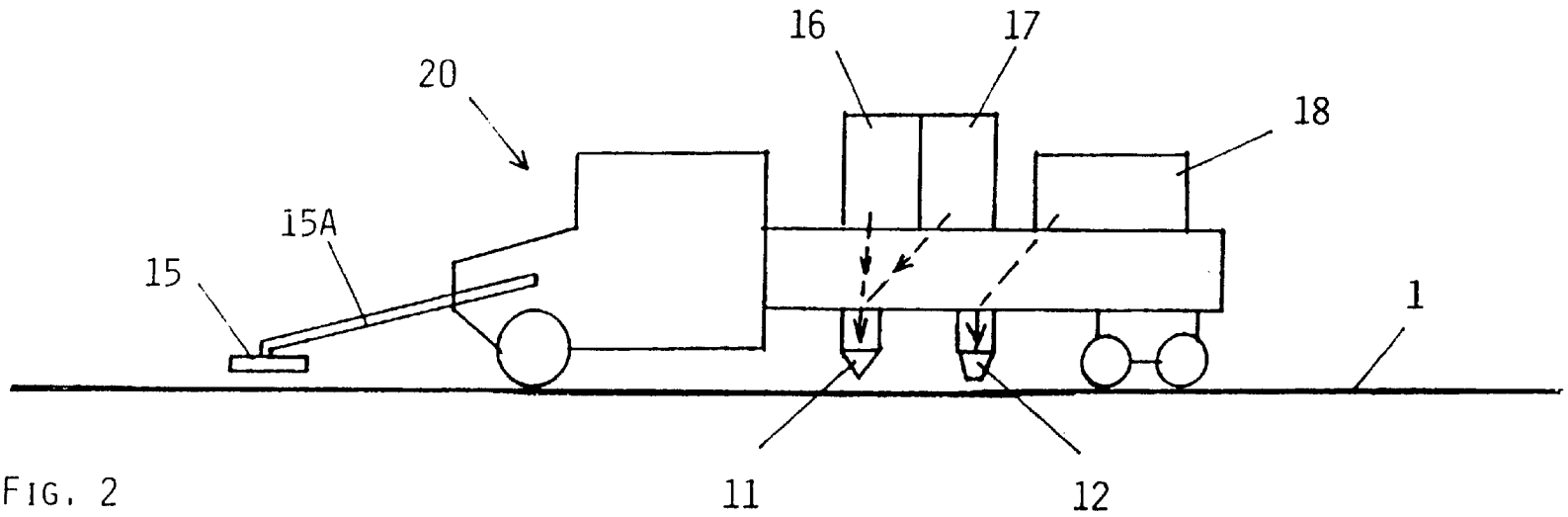

In the following description the invention will be explained more closely with reference to the drawings, wherein:

FIG. 1 shows a schematic cross section through the surface of a road pavement with an applied road marking, and FIG. 2 highly simplified shows a mobile equipment for carrying out the method according to the invention.

FIG. 1 shows a part of a road surface 1, which can be for example an asphalt pavement with irregularities or pores as indicated. At the surface there is in the first place applied a primer layer 2 which preferably is a heat curable epoxy plastic based on two or more components, being sprayed onto the road surface 1 in a suitable width for the subsequent laying down of the actual road marking mass 3 based on a suitable thermoplastic material. It is obvious that FIG. 1 shows both the primer layer 2 and the road marking mass 3 at a highly exaggerated thickness as seen in relation to the other dimensions.

The preferably heat curable primer layer 2 is applied advantageously at a thickness from 0.05–0.4 mm, whereas the thermoplastic mass 3 is laid down at a thickness being preferably within the range 0.4–6 mm. In actual practice such a combination has been found to be very favorable.

FIG. 2 illustrates a possible form of laying equipment being mobile on a truck 20. At the underside thereof between the front and rear wheels, there is provided a first spraying or dosing device 11 for the primer material, that can be supplied from a two-part tank 16,17, for the polymer component and the curing component respectively, in the case of a two-component material being employed. In the second place there is mounted a laying or dosing device 12 for the thermoplastic material supplied from a tank or pot 18 where this material is heated to a suitable temperature, such as within the range 150–230° C.

For the purpose of an efficient and safe performance of the method described above, the first and the second device 11 and 12 are mutually alined in the driving direction and at a spacing resulting in a favourable time relationship between the delivery of primer and thermoplastic material respectively. In practice the driving speed may be from 3–4 to 20 km/h.

In order to provide for a sufficiently short curing time for primer layer 2, it is possible in a manner known per se, to add an accelerator agent to the curing component in tank part 17. Moreover according to the invention it can be expedient to add a pigment to the primer composition delivered from dosing device 11, so as to give a desired colouring of the primer layer, for example white, so that the very resistant primer layer 2 (see FIG. 1) can constitute a "pre-marking" for road marking a next time when the actual road marking layer 3 has been more or less worn away.

Furthermore at the front of the truck 20 there is mounted a forwardly projecting arm 15A which carries a heating device 15, for example on the basis of gas heating, facing downwards towards the road surface. With such pretreating of the pavement a good road marking can be secured even under difficult conditions, such as cold weather or when there is rain. Such heating will be able to dry up the road surface to a significant degree during or after rain and at the same time heat up the surface somewhat, which is of particular interest on cold days. In summer heat the temperature of a road pavement of asphalt or concrete can reach 50° C. and it is then not required to use any heating device 15. Nor is there any need in such case for curing heat from the thermoplastic mass, for curing the primer layer. A particular effect of the heating device 15 is that the road surface is oxydized to a certain, desired degree and besides that a wax layer occuring at the surface of newly cast concrete pavements, is burnt away. This is also favorable for the desired adhesion of the road marking with the combination of a primer layer and a thermoplastic material as explained above.

Although there are types of heat curable plastic materials for the primer layer, that tolerate water to some degree, heating by means of the device 15 when marking road surfaces in rain, will be advantageous.

The method of road marking as described here, is secure, efficient and quick at the same time as there is obtained a wear-resistant marking with good adhesion properties. It is important that the marking operation can be done quickly, because road marking must often take place while the traffic on the road concerned, at least partially must continue, so that known methods may be more problematic in the case, inter alia, of employing usual primer types which require a good drying time or a specific after-treatment before the actual road marking mass is applied.

What is claimed is:

1. A method for applying markings or signs on a surface, comprising the steps of applying to the surface a primer layer comprising an uncured plastic material comprising two or more components, laying down on the primer layer a heated mass comprising a thermoplastic material, and initiating the curing of the primer layer by the heat of the heated mass of thermoplastic material.

2. The method according to claim 1, wherein the uncured plastic material is an epoxy resin comprising an epoxy component and a hardener component.

3. The method according to claim 1, wherein the primer layer further comprises a pigment.

4. The method according to claim 1, wherein the primer layer is applied in a thickness of 0.05–0.4 mm.

5. The method according to claim 1, wherein the heated mass of thermoplastic material is laid down in a thickness of 0.4–6 mm.

6. The method according to claim 1, further comprising the step of heating the surface before applying the primer layer to the surface below a primer curing temperature.

* * * * *